United States Patent [19]

Sachs et al.

[11] 4,244,749

[45] Jan. 13, 1981

[54] ULTRASONIC CLEANING METHOD AND APPARATUS FOR HEAT EXCHANGERS

[75] Inventors: Samuel L. Sachs, Columbia; Freeman K. Hill, Fulton, both of Md.

[73] Assignee: The Johns Hopkins University, Baltimore, Md.

[21] Appl. No.: 963,417

[22] Filed: Nov. 24, 1978

[51] Int. Cl.[3] ..... B08B 3/12

[52] U.S. Cl. ..... 134/1; 134/18; 134/184; 165/95; 367/154

[58] Field of Search ..... 134/1, 184, 18; 114/222; 165/95; 310/337; 366/127; 367/153, 154, 155, 156

[56] References Cited

U.S. PATENT DOCUMENTS

| | | | |
|---|---|---|---|
| 2,716,708 | 8/1955 | Bradfield | 367/155 X |
| 2,987,068 | 6/1961 | Branson | 134/184 |
| 3,068,829 | 12/1962 | Nuissl | 114/222 |
| 3,240,963 | 3/1966 | Sasaki | 134/1 X |
| 3,295,596 | 1/1967 | Ostrofsky et al. | 366/127 X |
| 3,640,295 | 2/1972 | Peterson | 134/184 X |
| 4,120,699 | 10/1978 | Kennedy et al. | 134/1 |

FOREIGN PATENT DOCUMENTS

| | | | |
|---|---|---|---|
| 1031166 | 5/1958 | Fed. Rep. of Germany | 114/222 |
| 1282552 | 7/1972 | United Kingdom | 134/184 |
| 1385750 | 2/1975 | United Kingdom | 134/184 |
| 1456664 | 11/1976 | United Kingdom | 134/1 |

*Primary Examiner*—Marc L. Caroff

*Attorney, Agent, or Firm*—Robert E. Archibald; Samuel Louis Sachs

[57] ABSTRACT

Biofouling is removed from the external surfaces of spaced apart pipes of a heat exchanger which are in contact with a liquid by positioning a plurality of ultrasonic transducers between the pipes and operating the transducers at sufficient power levels to cause cavitation within the liquid to effect the desired cleaning action. The transducers are arranged in a planar configuration to produce bi-directional acoustic radiation. Various types of instrumentation are provided for determining extent of biofouling and effectiveness of cleaning as well as for monitoring transducer operating parameters.

38 Claims, 7 Drawing Figures

ULTRASONIC CLEANING METHOD AND APPARATUS FOR HEAT EXCHANGERS

STATEMENT OF GOVERNMENT INTEREST

The Government has rights in this invention pursuant to Grant No. 04-6-158-44026 awarded by the U.S. Department of Commerce.

BACKGROUND OF THE INVENTION

1. Field of the Invention

The present invention relates to ultrasonic cleaning apparatuses and methods, and more particularly to an ultrasonic cleaning apparatus and method for effecting the cleaning of contaminating substances from irregular and/or relatively large surfaces submerged in sea water or the like so that cleaning can be accomplished without removal of the surfaces from the sea water.

2. Description of the Prior Art

The accumulation of foreign substances such as biofouling on metal surfaces which are submerged in liquids is well known. Biofouling is ubiquitous and as used herein is meant to incorporate all types of marine bological and non-biological fouling, including phenomenon known in common terms as barnacles, slime, algae, etc. The most difficult type of biofouling to remove is that caused by plants and animals which secrete a calcareous shell or exoskelton which by its nature becomes firmly cemented to the surface which is subject to the fouling.

When considering nautical apparatuses having components such as screws, rudders, boat hulls and the like, the effect of biofouling in terms of hydraulic drag is apparent. In order to remove or prevent biofouling several methods have been disclosed for such commonplace nautical instrumentalities.

One of the most widely used methods of preventing plant and animal associated fouling is the use of certain coatings which serve to halt growth for short periods of time or which, in some instances, serve only to slow growth. These paints or coatings work against biofouling by incorporating a soluble toxic compound that is released to poison biofouling organisms. The soluble toxic compounds are usually found in the salts of heavy metals such as copper, mercury, zinc, and arsenic. Unfortunately, these compounds have environmental complications and in some instance their use is severely restricted by Federal Regulations. In addition, these coatings have short lives and therefore the coating procedure must be repeated numerous times during the life of the maritime object to insure ongoing protection.

U.S. Pat. No. 4,058,075 issued to D. R. Piper, Sr. on Nov. 15, 1977, discloses another approach to the inhibition of marine life growth. Piper, Sr. suggests the use of several audio speakers attached to the inside of a boat hull or the like where the speakers are driven by 60 cycle AC so that they produce sound and therefore vibrations which inhibits or prevents marine growth on the exterior of the hull. While it is possible that this sytem will inhibit marine growth, it is quite unlikely that sufficient audio could be propagated through the hull to remove accumulations of biofouling. Therefore, this system must be in constant use in order to prove effective. Furthermore, the constant huming produced by the speakers would be a major annoyance to the occupants of the boat. In addition, this system is not readily adaptable for use over large areas or in configurations other than boat hulls, such as heat exchangers, since power levels required to be effective would be astronomical.

Another approach to the prevention of biofouling is disclosed in U.S. Pat. No. 3,309,167 issued to S. Gallar on Mar. 14, 1967. Gallar proposes the use of a heating element mounted on the interior of surfaces exposed to a marine environment. The heating of these surfaces acts as a deterrent for the growth of certain types of biofouling. However, the amount of power necessary to heat the entire surface of an object disposed in a marine environment is entirely impractical. Furthermore, if this system was to be used in conjunction with a heat exchanger submerged in a marine environment, the heat exchanger's function would be seriously impaired if not destroyed since heat transfer would not be properly accomplished through a heated surface, for whatever reason.

The question of preventing biofouling on a heat exchanger disposed in a marine environment was addressed in U.S. Pat. No. 4,062,189, issued to D. Mager et al on Dec. 13, 1977. Prior to Mager's proposal, the primary means of cleaning heat exchangers was the use of brushing or scraping implements or apparatuses which would mechanically attack biofouling and scrape the same from the surfaces of the heat exchanger. In an effort to advance the state of the art, Mager proposes to enhance the inherently inefficient method of mechanical scraping by reversing the cold and hot water flows over the heat exchanger periodically so that biofouling which is induced to grow is killed and then may be more easily scraped from the external surfaces of the heat exchanger.

Another proposal for cleaning biofouling from surfaces in contact with sea water is proposed in U.S. Pat. No. 3,068,829, issued to C. W. Nuissl, on Dec. 18, 1962. Nuissl teaches the use of an "Ultrasonic Energy Cleaner" which comprises a shell having disposed therein, what is called, "at least one high energy ultrasonic wave generator". The alleged "high energy ultrasonic wave generator" is actually an impeller driven by an electric motor mounted behind a plate having a plurality of holes disposed therethrough. The impeller draws water and forces it through the holes in pulses. As is well known in the ultrasonic arts, at best, the device of Nuissl can produce some type of streaming or water wave motion but because of the physical constraints of such an apparatus it cannot produce true ultrasonic cleaning or cavitation.

Ultrasonic cavitation cleaning in a marine environment is taught in U.S. patent application Ser. No. 776,578 filed on Mar. 11, 1977 by the U.S. Department of the Navy. This application has been made available prior to issue through the National Technical Information Service and teaches a thermal oceanographic sensor which is mounted on a substrate that comprises an ultrasonic transducer of the piezo-electric crystal type. When the ultrasonic transducer is energized, it effectively cleans itself and therefore cleans the thermal probe which is mounted thereon. No means are shown or suggested for propagating the ultrasound radiated from the transducer to clean surfaces other than its own.

In the area of general ultrasonic cleaning, U.S. Pat. No. 3,173,034 issued to C. W. Dickey et al on Mar. 9, 1965, discloses a low loss flexible ultrasonic transmission line for conducting ultrasonic energy to a remote location. U.S. Pat. No. 4,071,376 issued to L. M.

McNear on Jan. 31, 1978 teaches an ultrasonic cleaner having a floating transducer which is configured in a doughnut-like shape for cleaning nuclear fuel casks. A plurality of transducers are disposed adjacent to the interior surfaces of the doughnut so that the nuclear fuel cask can be accommodated therethrough for cleaning.

The present invention addresses itself specifically to the cleaning of heat exchangers incorporated in ocean thermal energy conversion plants, however, the teachings thereof are specifically applicable to various other types of structures found in a marine atmosphere. The concept of an ocean thermal energy conversion plant is well known in the art. When the plant proposes to do is to extract thermal energy from the sun that is stored in tropical waters to generate electricity. These ocean thermal energy conversion systems are in effect giant Rankine engines which exploit the $\Delta T$ between the surface of the ocean and depths several thousand feet therebeneath. It should be apparent, that in order to exploit this $\Delta T$, massive heat exchangers must be used, through or over which sea water must flow. The efficiency of the ocean thermal energy conversion plants is largely dependent upon the thermal transfer by the heat exchangers. Therefore, if biofouling accumulates on the heat exchanger and the heat transfer is reduced, the efficiency of the plant will be seriously impaired, possibly to the point where operation becomes implausible.

The ocean thermal energy conversion systems which rely upon sea water passing through the interior of the pipes of their heat exchangers have approached the problem of cleaning by passing abrasive pigs or sponges through the pipes under water pressure to scrape the interior surfaces thereof. Some quarters in the ocean thermal energy conversion plant field believe that the most practical and desirable plant will be one wherein the sea water flows over the exterior surfaces of the heat exchanger and a working fluid such as ammonia or the like is flowed through the interior surfaces of the exchanger. Unfortunately, this subjects the irregular and substantially inaccessible exterior surfaces of the heat exchanger to biofouling. To date, the only proposals which have been made for cleaning the exterior surfaces of these heat exchangers are the use of mechanical scraping or brushing means and the possible reversal of the heat exchange cycle so that areas are periodically changed from cold to hot. The reversal of the cycle is very impractical since the heat exchangers will most likely be in excess of 15,000 cubic feet each with a moderate size plant having an excess of 40 heat exchangers. The physical task of shifting the heat exchangers to reverse the flow would be almost unaccomplishable. Alternately, if the flow was to be reversed with the heat exchanger in position, massive plumbing would be required. Other systems which have been proposed include the use of water jets which are directed against the exterior surfaces of the heat exchanger to prevent bifouling from accumulating thereon. However, it is known that these systems will be entirely ineffective in removing accumulated deposits and the energy as well as the pumping system required to keep them constantly running to permit accumulations will be prohibitive. In addition, if there are some malfunctions and the system cannot be used continuously, the biofouling which will accumulate during the down time will be virtually impossible to remove. Conventional techniques such as coatings are undesirable for use with heat exchangers because they reduce heat transfer in some instances and also have environmental complications. Environmental complications are also the major concern with chemical systems wherein a toxic substance is periodically disbursed to preclude accumulation of biofouling.

Considering all of the above complications and problems, the primary consensus in the ocean thermal energy conversion field has been that mechanical brushing or scrubbing seems the most likely candidate for cleaning of biofouling from the heat exchangers of the ocean thermal energy conversion plants, however, inefficient and cumbersome these mechanical systems might be.

The present invention overcomes the problems associated with the prior art and fulfills the need for efficiently and effectively cleaning biofouling from the external surfaces of the heat exchangers of ocean thermal energy conversion plants by providing an ultrasonic cleaning apparatus which can be used in combination with a heat exchanger to accomplish complete and effective removal of biofouling. In addition, the apparatus of the present invention, when employed with the method thereof, is suited for applications other than the cleaning of heat exchangers.

SUMMARY OF THE INVENTION

Therefore, a primary object of the present invention is to provide an ultrasonic cleaning system which is suited for in situ cleaning of relatively large irregular surfaces in a marine environment.

A further object of the present invention is to provide an ultrasonic cleaning apparatus which is ideally suited for use with a heat exchanger configured for use in an ocean thermal energy conversion plant.

A still further object of the present invention is to provide an ultrasonic cleaning apparatus and a method for the use thereof for in situ removal of biofouling.

Still another object of the present invention is to provide an ultrasonic cleaning apparatus which is easily calibrated, and which is readily serviceable.

Still another further object of the present invention is to provide an ultrasonic cleaning apparatus which is capable of being configured so that it may be deployed in relatively narrow spaces.

Another further object of the present invention is to provide a method for mounting ultrasonic transducers in a waterproof assembly which maximizes the transmission of ultrasonic energy from the assembly and simultaneously minimizes extraneous vibration.

Still another object of the present invention is to provide a cleaning apparatus wherein the effectiveness thereof improves when the depth at which it is used increases even though the apparatus can not be seen.

Another still further object of the present invention is to provide an ultrasonic cleaning apparatus which is simple in design, inexpensive to manufacture, rugged in construction, easy to use, and efficient in operation.

These objects, as well as further objects and advantages of the present invention will become readily apparent after reading the ensuing description of a nonlimiting illustrative embodiment and the accompanying drawings.

In one embodiment, the present invention provides an apparatus for in situ cleaning of foreign substances from a portion of an object submerged in a liquid and includes a planar array of ultrasonic transducers capable of producing ultrasonic energy at power levels sufficient to cause cavitation of the liquid medium for cavitation type cleaning and means for positioning the ultrasonic array so as to permit ultrasonic energy to be directed toward the portion of the object to be cleaned. Another embodiment of the invention provides an apparatus for effecting heat exchange in a fluid environment in combination with an ultrasonic cleaning means for in situ cleaning of the heat exchange apparatus. Methods for employing the ultrasonic cleaning means of the present invention for in situ cleaning are also disclosed and include the steps of positioning the ultrasonic cleaning means within a fluid proximate to the surface to be cleaned so that energy radiated from the cleaning means is directed towards the surface, applying power to the ultrasonic cleaning means, and moving the ultrasonic cleaning means relative to the surface to be cleaned at a rate permitting the cleaning thereof.

BRIEF DESCRIPTION OF THE DRAWING

In order that the present invention may be more fully understood it will now be described, by way of example, with reference to the accompanying drawings in which.

DESCRIPTION OF THE PREFERRED EMBODIMENTS

Figure 1:
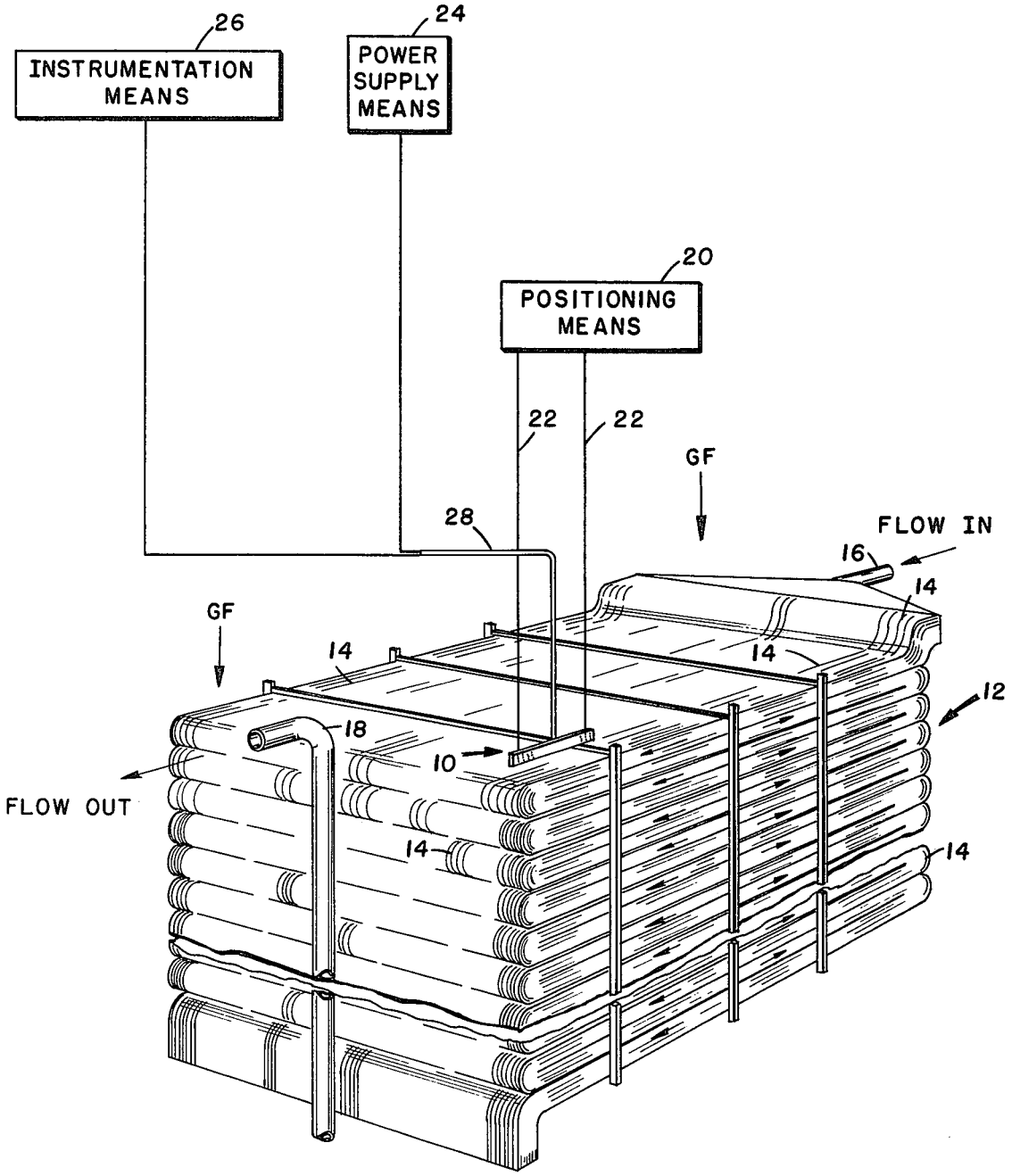
FIG. 1 is a pictorial representation of one embodiment of the combination of the heat exchanger and the ultrasonic transducer apparatus of the present invention.

Referring now to Figures, and more particularly to FIG. 1 thereof, there is illustrated therein an ultrasonic cleaning apparatus 10, incorporating the principals of the present invention therein, in close proximity to a heat exchanger 12 prior to the cleaning thereof. The heat exchanger 12 comprises a plurality of banks of substantially parallel tubes or pipes 14 which are in communication so that a flow of liquid can take place from the input 16 of the heat exchanger 12 to the output 18 thereof. The heat exchanger 12, as illustrated, is designed for incorporation in an ocean thermal energy conversion plant and would therefore be immersed in sea water so that all the external surfaces of the pipes 14 are in contact therewith. The heat exchanger 12 is employed so that heat exchange can take place between the sea water and the working fluid passing through the heat exchanger 12. As a result of the organic and inorganic fouling activity which customarily takes place in sea water, the exterior surfaces of the pipes 14 will be subject to biofouling and therefore, over a period of time, the heat exchange therethrough will be reduced which will subsequently lower the overall efficiency of the ocean thermal energy conversion plant.

Figure 3:
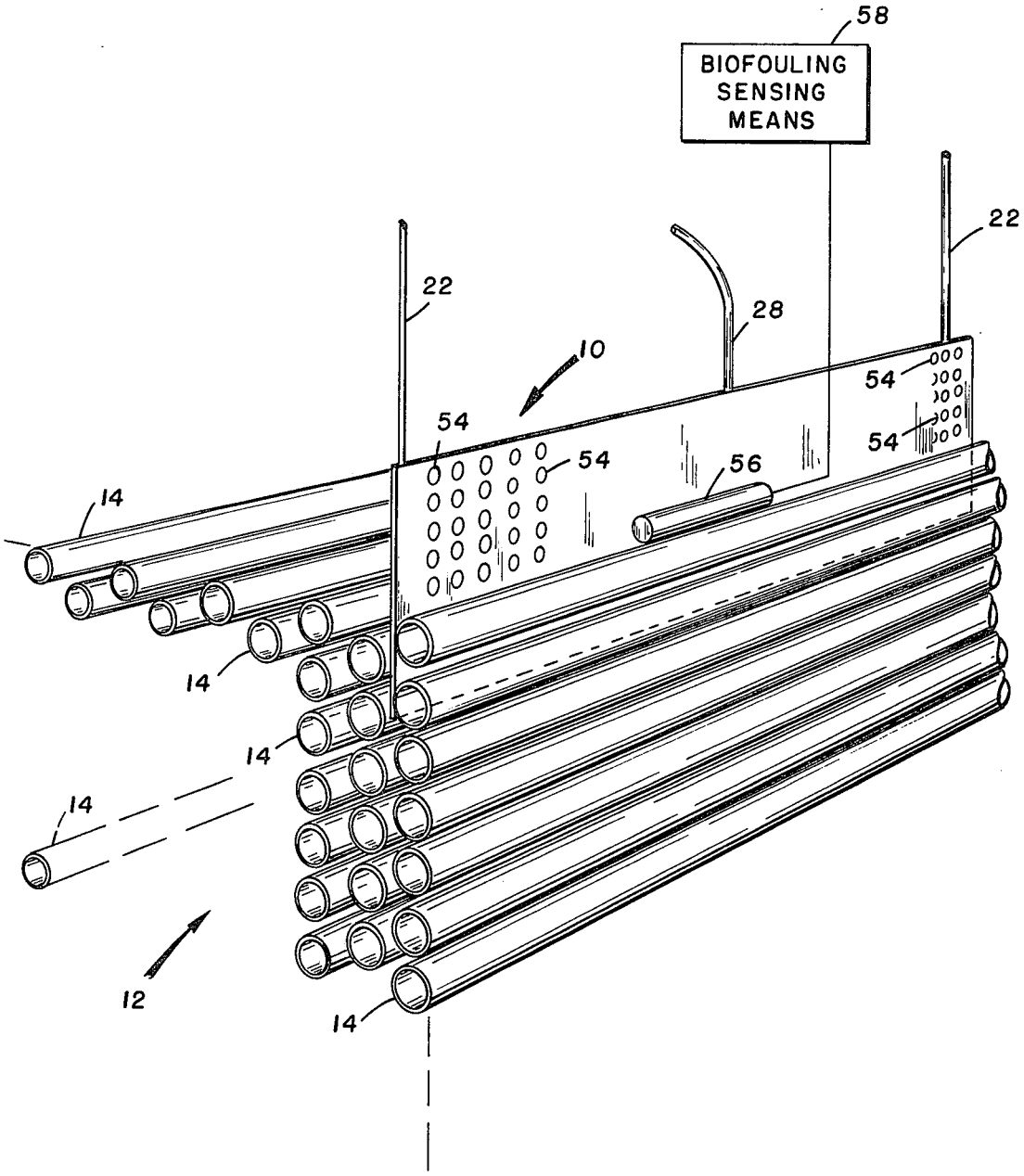
FIG. 3 is a partially broken-away enlarged perspective view of the ultrasonic cleaning apparatus of the present invention disposed in between a plurality of pipes of the heat exchanger.
Figure 5:
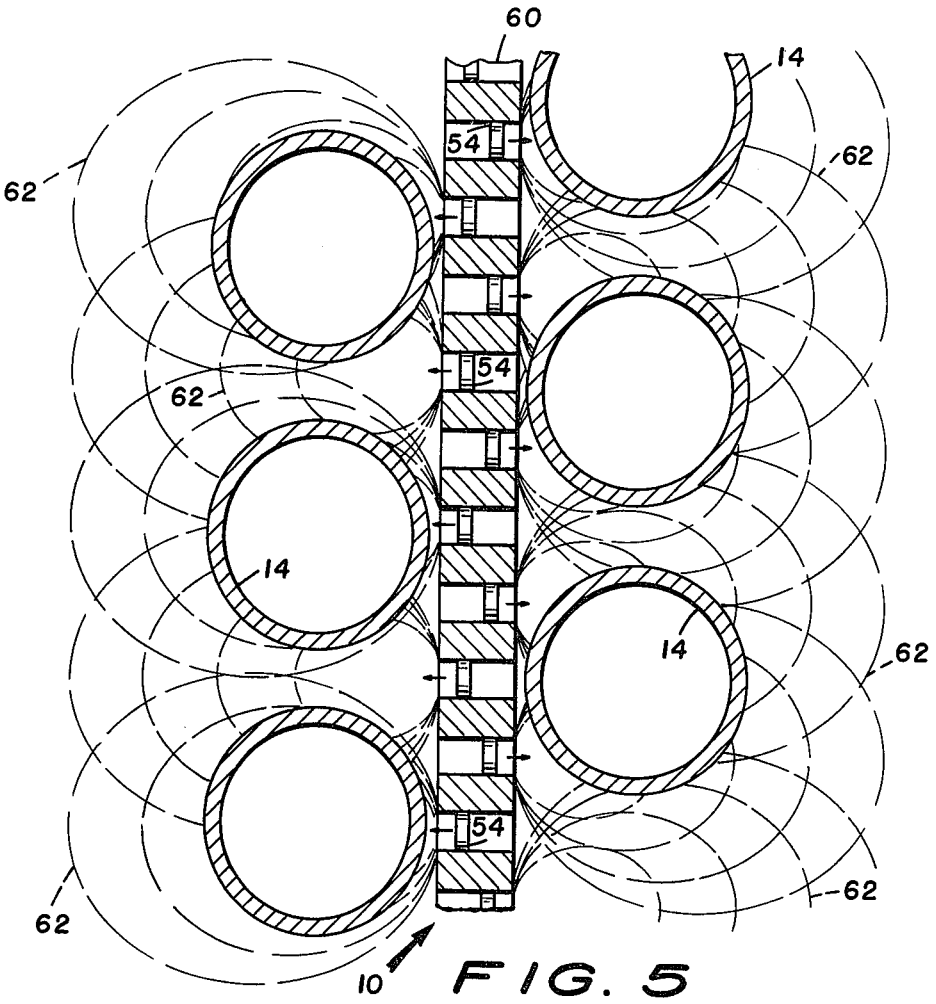
FIG. 5 is cross-sectional view of the ultrasonic cleaning apparatus of the present invention disposed between parallel banks of heat exchanger pipes and the radiation pattern from the ultrasonic cleaning apparatus.

The ultrasonic cleaning apparatus 10 is configured so that it may be positioned between the parallel banks of pipes 14 of the heat exchanger 12, as illustrated in FIGS. 3 and 5, and is intended for use to clean the aforementioned exterior surfaces of the pipes 14 from biofouling. The ultrasonic cleaning apparatus 10 will be hereinafter described in detail both as to function and construction.

Because of the relative sizes of the ultrasonic cleaning apparatus 10 and the heat exchanger 12, the cleaning apparatus 10 is moved to various locations within the heat exchanger in order to effect the proper cleaning of the exterior surfaces thereof. This is accomplished by a positioning means 20 from which the ultrasonic cleaning apparatus 10 is suspended by a plurality of cables 22. In one embodiment, the positioning means would comprise a user manipulated crane which would permit movement of the apparatus 10 to different locations within the heat exchanger 12 and also permit the raising and lowering of the apparatus 10 between the substantially parallel banks of pipes 14. While monitored by the user, the apparatus 10 would be raised and lowered at a predetermined rate and then moved in sequence to another location so that, in turn, the entire heat exchanger 12 would be cleaned. Ultimately, the positioning means 20 could comprise a motor-driven XYZ positioning apparatus wherein a frame would be disposed above the heat exchanger and, according to prearranged instructions, either supplied by a user or by a microprocessor, would address various locations above the heat exchanger 12. Once the apparatus 10 was positioned in these locations it then would be raised and lowered according to a predetermined program, once again by the microprocessor or the user, to assure complete cleaning of the heat exchanger 12. Various guide means or the like may be incorporated in the heat exchanger for directing the movement of the cleaning apparatus 10 therein. For example, tracks of the like may be provided as an integral part of the heat exchanger through which the cleaning apparatus 10 could be moved by the positioning means 20. In addition, the ultrasonic cleaning apparatus itself may be provided with a power drive as well as various guides or tracks which would enhance the precise guidance of the same through the heat exchanger 12.

Suitable power supply means 24 and instrumentation means 26 as hereinafter described are connected to the ultrasonic cleaning apparatus 10 by suitable cabling 28.

Figure 2:
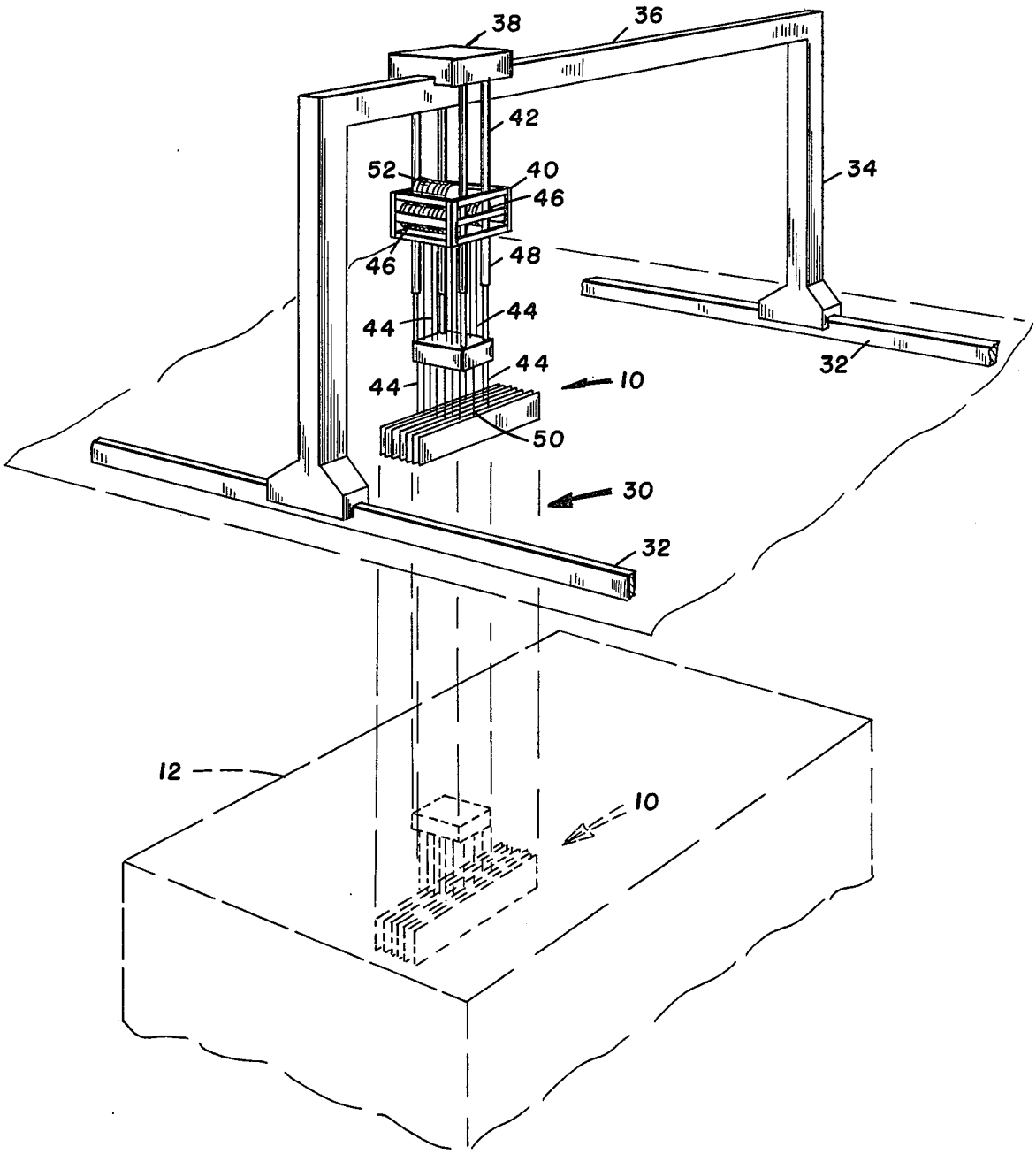
FIG. 2 is a perspective view of a mechanism for lowering the ultrasonic cleaning apparatus of the present invention into a heat exchanger thereof.

With reference to FIG. 2 there is illustrated therein one embodiment of a positioning means for effecting cleaning of a heat exchanger 12, shown in phantom lines by the ultrasonic cleaning apparatus 10. The heat exchanger 12 is located in a desired position and directly above the same is located a gantry 30 having a pair of guiderails 32. A motor-driven support 34 operably engages the guiderails 32 so that the apparatus may be transported directly above the heat exchanger 12. The motor-driven driven support 34 provides a rack portion 36 on which a motor-driven transport 38 can travel. The geometry of the gantry 30 and the motor-driven support 34 in such that movement provided by the motor-driven support 34 on the guiderails 32 is substantially perpendicular to movement provided by the motor-driven transport 38 on the track portion 36 of the support 34. A winch housing 40 is suspended from the motor-driven transport 38 by a plurality of supports 42. A plurality of support cables 44 are suspended from the support winches 46 and mounted on the lowermost ends thereof are a plurality of ultrasonic cleaning apparatuses 10. The ultrasonic cleaning apparatuses 10 are spaced apart so that they may accommodate therebetween the parallel banks of pipe provided by the heat exchanger 12. In order to prevent excessive swinging of the ultrasonic cleaning apparatuses 10 on the support cables 44, a telescopic guide assembly 48 is provided. Power is supplied to the ultrasonic cleaning apparatus 10 by a power cable 50 which is raised and lowered by a power cable winch 52.

When it is desirable to clean a portion of the heat exchanger 12, the motor-driven support 34 and the motor-driven transport 38 are positioned directly above the portion to be cleaned. The support winches 46 and the power cable winch 52 are then energized so that the ultrasonic cleaning apparatuses 10 can be lowered into the heat exchanger. When the ultrasonic cleaning apparatuses 10 are disposed within the heat exchanger, the apparatuses 10 can be energized to effect cleaning. The positioning of the motor-driven transport 38, and the motor-driven support 34 as well as the positioning and lowering of the ultrasonic cleaning apparatuses 10 may be done by manual inspection or suitable microprocessor control can be provided which will direct the positioning and functioning of these apparatuses so that they arrive at a precise preselected address and proceed from that address to another address to completely clean the exterior surfaces of the heat exchanger apparatus.

The particular number of the ultrasonic cleaning apparatuses 10 is not limited by the illustration but can be varied according to the requirements of a particular installation. Furthermore, the dimensions of the ultrasonic cleaning apparatuses 10 can be latered so that a proper relationship between the area to be cleaned and the surface area of the ultrasonic cleaning apparatuses 10 are arrived at. While a specific embodiment of a positioning means for bringing the ultrasonic cleaning apparatuses 10 to the heat exchanger 12 is illustrated, it should be apparent to one skilled in the art that various modifications of the particular apparatus shown in FIG. 2 as well as other apparatuses may be effectively employed. In addition, varible control functions to regulate the maneuvering of the ultrasonic cleaning apparatuses 10 relative to the heat exchanger 12 may be employed. For instance, it is possible that different sections of the heat exchanger may require different cleaning times because of location. Alternately, different cleaning rates may be needed for different seasons. Once a predictable pattern can be established, a microprocessor control would be programmed to give different areas of the heat exchanger different lengths of cleaning time or the entire heat exchanger different cleaning rates.

It should be noted that since the ultrasonic cleaning apparatuses 10 can be entirely withdrawn from the heat exchanger 12 when cleaning is not being accomplished, that these units are readily serviceable if necessary. Once the biofouling is removed from the external surfaces of the heat exchanger 12 it is apparent that this removed biofouling should be flushed from the heat exchanger. This can be accomplished by flowing water over the heat exchanger. In the instant case of an ocean thermal energy conversion power plant, a natural gravitational flow, designated in FIG. 1 as GF, will occur since this type of ocean thermal energy conversion plant is characteristically provided with a pumped flow of water over the heat exchangers so that the biofouling will automatically be flushed away from the external surfaces of the heat exchanger 12 after the loosening of the fouling therefrom.

FIGS. 3 through 7 illustrate the details of the construction of the ultrasonic cleaning apparatus 10 and the manner in which the apparatus functions. With specific reference to FIG. 3, there is illustrated therein the ultrasonic cleaning apparatus 10 partially inserted between the plurality of substantially parallel banks of pipe 14. As can be seen, the distance between the banks of pipe 14 is relatively small and the planar configuration of the ultrasonic cleaning apparatus is therefore quite satisfactory for insertion into such confined spaces. Ultrasonic energy is caused to be radiated from the ultrasonic cleaning apparatus 10 by a plurality of transducers 54 disposed therein as illustrated. The orientation of the transducers 54 and the mounting thereof will be hereinafter described. Because of the arrangement of the transducers 54 in a planar array within the ultrasonic cleaning apparatus 10, extremely effective cleaning can take place ven though only minimum access to the interior of the heat exchanger 14 is possible.

In order for the user to determine when the heat exchanger 12 needs cleaning and when such cleaning has been satisfactorily accomplished, a tubular surface or probe 56, the external surface of which is constructed of a material similar to that of the pipe 14, is disposed within the heat exchanger 12 so that it is exposed to the same type of biofouling as the heat exchanger itself. The tubular surface 56 is operably connected to a biofouling sensing means 58 which includes instrumentation, well known in the art, for determining the heat exchange capabilities of the tubular surface or probe 56. As a result, the biofouling sensing means 58 can determine when the heat exchange between the tubular surface 56 and the surrounding fluid environment has been reduced by biofouling. When this is the case, it is apparent that not only the tubular surface 56 has been fouled but that also the pipes 14 have been covered with biofouling. The information from the biofouling sensing means 58 can then be directly fed to the microprocessor, hereinbefore described, which controls the functioning of the ultrasonic cleaning apparatus 10, or may be read out in a suitable manner for consideration by the user so that he may institute manual manipulation of the ultrasonic cleaning apparatus 10 to clean the heat exchanger 12.

When the ultrasonic cleaning apparatus 10 is energized within the heat exchanger 12 adjacent to the tubular surface 56, as the biofouling is cleaned from the heat exchanger, it also will be cleaned from the tubular surface 56. When the biofouling sensing means 58 indicates to the ultrasonic cleaning apparatus 10, either directly, or through the intervention of the user that the biofouling has been cleaned from the tubular surface 56, the ultrasonic cleaning apparatus 10 can be deenergized or moved to another location to permit further cleaning. In practice, a plurality of probes 56 can be placed at strategic locations within the heat exchanger 12 to uniformly monitor the build-up and/or cleaning of biofouling.

Other methods for determining when the heat exchanger 12 needs cleaning and when sufficient cleaning by the ultrasonic cleaning apparatus 10 has been effected upon the heat exchanger 12 can also be employed. The obvious method would be for the user to inspect the heat exchanger to determine when there is fouling and also to inspect the same to determine when the fouling has been cleaned. However, this method is largely impractical since the heat exchanger apparatus 12 will be of substantial size if it has been dimensioned for use of the ocean thermal conversion plant and since the depth of the exchanger 12 will quite likely be over 60 feet. Alternate methods of inspection may include measuring of the heat exchange capability of the entire heat exchanger 12, optical inspection of the heat exchanger 12, and/or judicious pre-selection of the frequency and duration of the intervals at which the heat exchanger will be cleaned.

Figure 4:
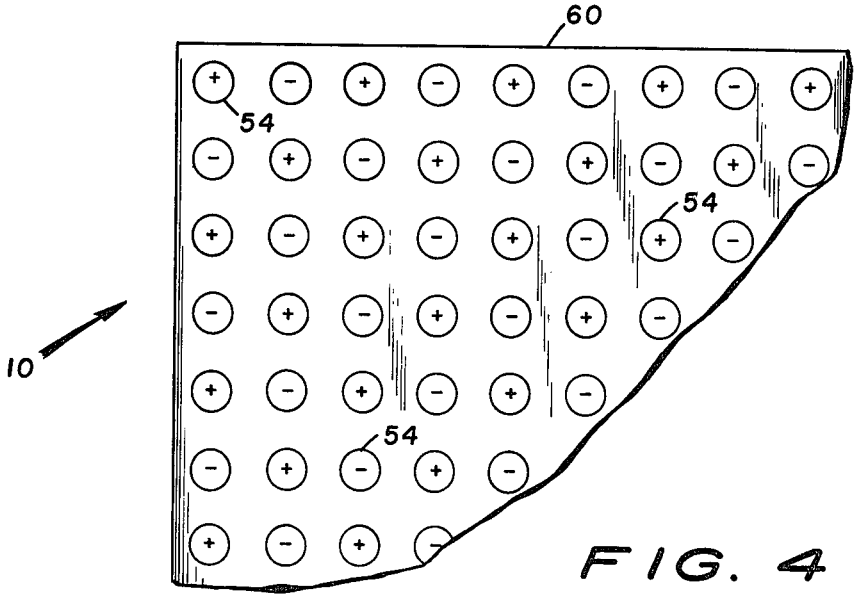
FIG. 4 is a pictorial representation of the preferred arrangement of the transducers within the ultrasonic cleaning means of the present invention to permit bidirectional radiation therefrom.

FIG. 4 illustrates the desired manner in which the ultrasonic transducers 54 will radiate from the ultrasonic cleaning apparatus 10. The transducers 54 have been marked with plus signs and minus signs to indicate whether or not they radiate toward the viewer of FIG. 4 or away from the viewer of FIG. 4. The transducers, which are arranged in rows and columns, are oriented so that they radiate in alternate directions of produce bi-directional radiation from the cleaning apparatus 10. The exact manner in which the transducer 54 are mounted within the apparatus 10 may vary and will be hereinafter discussed.

Referring to FIG. 5, because of the bi-drectional radiation from the cleaning apparatus 10, two adjacent banks of pipes 14 may be simultaneously cleaned. The transducers 54 are shown mounted within a support plate 60 and are oriented so that alternate transducers radiate in opposite directions. The radiation patterns of each of the transducers 54 are illustrated by the phantom lines 62. The distance between the centers of each of the transducers 54 is preferably an integral number of one half-wave lengths of the operating frequency of the transducers so that an interference pattern as illustrated will be produced which will clean every external surface of the pipes 14 when the ultrasonic cleaning apparatus 10 is properly positioned within the heat exchanger 12. The placement of the transducers relative to the support plate 60 in FIG. 5 is not meant to be limiting but is merely an illustration of one manner in which this may be accomplished and one configuration which may be used.

The ultrasonic transducers 54 preferably operate between 18 Khz and 80 Khz. Suitable transducer materials include lithium niobate, lithium tantalate, barium sodium niobate, bismuth germenate, lead titanate zirconate, and barium titanate. Because of the physical restrictions of the heat exchanger 12, the above-noted piezo-electric materials are preferred. However, where space is not a primary consideration, other types of transducers well known in the art may be employed. The most effective cleaning can be accomplished by the ultrasonic cleaning apparatus 10 if the power levels radiated therefrom reach and exceed the cavitation threshold of the sea water or other fluid in which the heat exchanger 12 is disposed. Basically, the cavitation threshold $I_c$ can be determined by the following formula:

$$I_c=[(0.707)\ 10^{6}P_c]^2\times10^{-7}=0.3\ P_c\ \text{watt/cm}^2/\rho C$$

Where $P_c$ equals the peak pressure of sound wave causing cavitation per atmosphere, where $\rho$ equals one gram/cm$^3$, and C equals $1.5\times10^5$ cm/second. Therefore, a cavitation threshold at one atmosphere is equivalent to a plane wave intensity of 0.3 watts per cm$^2$. With 0.3 watts/cm$^2$ being the plane wave threshold, the desired power level radiated from the ultrasonic cleaning apparatus 10 would be between 0.5 to 2 watts cm$^2$ to insure that cavitation is taking place. It is interesting to note that pressure increases the effectiveness of ultrasonic cleaning up to 7 or 8 atmospheres. As a result, the farther down the ultrasonic cleaning apparatus 10 is employed, the more effective the cleaning will be, quite the converse of the cleaning problems which are encountered through the use of mechanical scraping or brushing. In fact, if the pressure is increased the power level under certain circumstances can be reduced.

Because of the modern technique of exciting wafer-type transducers in the thickness mode using odd harmonics of the base frequency, it is quite possible to consider thicknesses within $\frac{3}{4}$ to 1" for the transducers 54. This would permit disposition of a relatively thin apparatus 10 between closely spaced banks of pipes 14. Because the heat exchangers are disposed in a substantially open system, i.e., sea water, any heat generated by the ultrasonic cleaning apparatus 10 when the transducers 54 are energized will be automatically and quickly dissipated to the liquid medium without adversely affecting the operation of the apparatus 10 or the heat exchanger 12. Means can be provided to preclude accidental energization of the transducers 54 when they are not disposed within a liquid medium.

Figure 6:
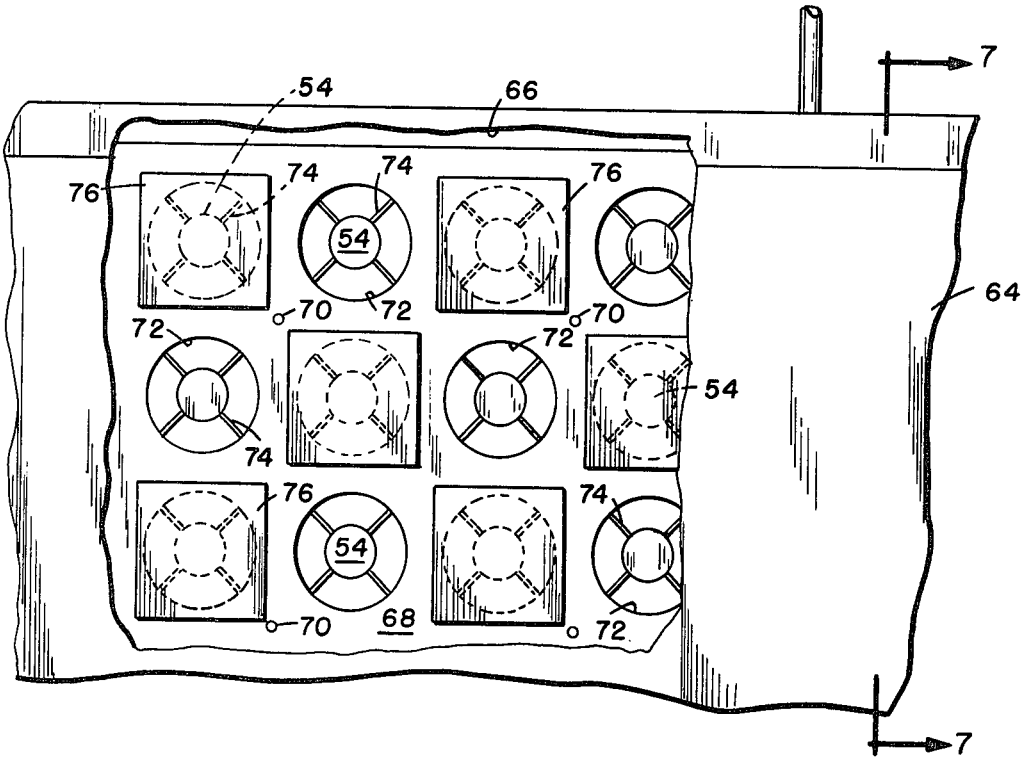
FIG. 6 is a partially broken away fragmentary view of the ultrasonic transducer apparatus of the present invention.
Figure 7:
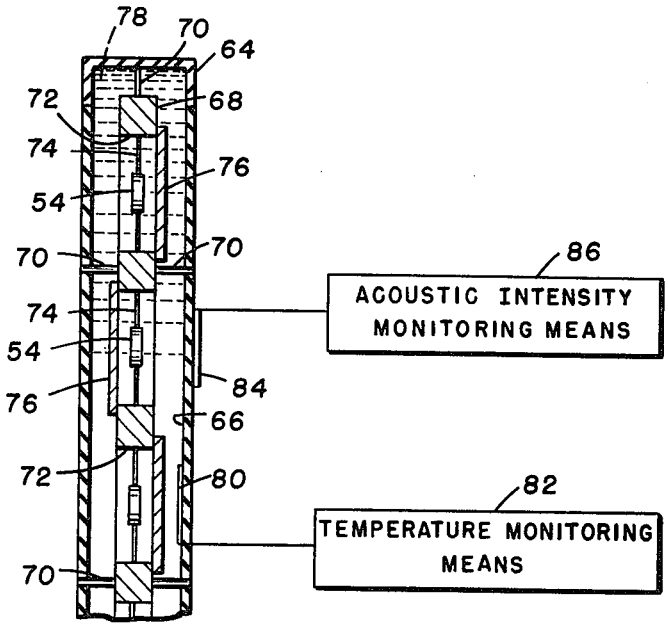
FIG. 7 is a cross-sectional view of the apparatus of FIG. 6 taken substantially along the line 7—7 thereof.

FIGS. 6 and 7 illustrate, in detail, the construction of the ultrasonic cleaning apparatus 10. The ultrasonic cleaning apparatus 10 includes a housing 64 which defines a chamber 66 therein. A plate 58 is fixedly secured within the chamber 66 by a plurality of mounting posts 70 which are each fixedly secured on one end thereof to the plate 68, the other ends thereof being fixedly secured in a suitable manner to the interior surfaces of the housing 64.

A plurality of apertures 72 are disposed through the plate 68 and are dimensioned to accommodate therein a plurality of ultrasonic transducers 54. The apertures 72 are disposed through the mounting plate 68 in a symmetrical row and column configuration with the centers of each of the apertures 72 being spaced one half wavelength from the adjacent aperture 72, the wavelength being determined by the operating frequency of the transducers 54. The transducers 54 are each mounted within the apertures 72 by a plurality of support posts 74 each fixedly secured one end thereof to a transducer 54, the other end of each of the support post 74 being fixedly secured to the perimeter of the aperture in which it is disposed with the support post 74 being mounted in a radial fashion relative to the transducers 54. Each of the support posts 74 are preferably constructed of a vibration dampening material so that vibration of the transducers 54 will not be transmitted to the plate 68. The cables which supply power to the transducers 54 may be mounted along the surface of the plate 68 in any suitable manner. A plurality of cover plates 76 which act as acoustical reflectors are disposed over opposite ends of the apertures in alternate rows and columns so that bi-directional radiation is provided for by the ultrasonic cleaning apparatus 10. The cover plates 76 may be secured to the plate 68 in any suitable manner and may be rearranged as desired by the user. The cover plate 76 would most likely be constructed of a metallic material and would be bolted into position over the aperture 72 of the plate 68.

The housing 64 is preferably constructed of a semi-resilient material such as rubber or the like and would be filled with a viscous liquid 78 through which ultrasonic radiation from the transducers 54 can propagate to and through the housing 64 to the surrounding environment. The semi-resiliency of the housing 64 aids the propagation of ultrasonic radiation therethrough and also precludes damage to the pipes 14 of the heat exchanger 12 through mechanical contact. In order to monitor the correct operation of the ultrasonic cleaning apparatus 10, a thermal probe 80 which is operably coupled to a temperature monitoring means 82 is disposed within the chamber 66 of the housing 64 to monitor the temperature of the interior of the housng. If this temperature becomes excessive, the ultrasonic cleaning apparatus 10 can be shut down prior to possible failure of the transducers as a result of overheating. Similarly, in order to make sure that the ultrasonic transducers 54 are radiating acoustical energy, a probe 84, which is operably connected to an acoustic intensity monitoring means 86 is mounted to an exterior surface of the housing 64. Test instruments which monitor radiated acoustical energy are well known in the art and would form the substance of the monitoring means 86. By either manually or automatically monitoring both the radiated acoustical intensity of the ultrasonic cleaning apparatus 10 and the temperature thereof an excellent indication of correct operation and possible malfunctions will be instantly at hand at any time. If the ultrasonic cleaning apparatus 10 is directed by a microprocessor as hereinbefore described, the information ascertained by the temperature and acoustic intensity monitoring means can be fed into the microprocessor to permit shut-down or appropriate correctional action as predetermined by the user.

It will be understood that various changes in the details, materials, arrangements of parts, and operational conditions which have been herein described and illustrated in order to explain the nature of the invention may be made by those skilled in the art within the principals and scope of the invention.

Having thus set forth the nature of the invention, what is claimed is:

1. An apparatus for effecting useful heat exchange in a liquid environment and a device for cleaning said apparatus in said liquid environment without removal therefrom comprising in combination:

heat exchange means comprising a plurality of substantially parallel spaced apart banks of pipes each having external surfaces exposed to said liquid environment wherein said surfaces are subject to having substances accumulate thereon as a result of said liquid being in contact therewith, said substances affecting adversely the transfer of heat through said surfaces;

ultrasonic cleaning means for producing ultrasonic energy in sufficient quantities to produce cavitation of said liquid to dislodge said substances, said ultrasonic cleaning means comprising a plurality of transducers arranged in a portable array and powered by suitable power supply means; and means for positioning said ultrasonic cleaning means adjacent to said surfaces between said banks of pipes without removal of said surfaces from said liquid environment.

2. A combination in accordance with claim 1, further comprising means for sensing biofouling on said heat exchange apparatus.

3. A combination in accordance with claim 1, wherein said positioning means comprises means for moving and indexing said ultrasonic cleaning means relative to said heat exchange means.

4. A combination in accordance with claim 1, further comprising means for determining when said substances have been removed from said heat exchange means.

5. A combination in accordance with claim 1, wherein said ultrasonic cleaning means operates in substantially the range of 18 Khz to 80 Khz.

6. A combination in accordance with claim 1, wherein said ultrasonic cleaning means effects cavitation-type cleaning of said heat exchange means.

7. A combination in accordance with claim 6, wherein said cavitation-type cleaning, at one atmosphere of pressure, is accomplished at power levels between 0.5 to 2 watts/cm$^2$.

8. A combination in accordance with claim 1, further comprising means for removing said substances from the proximity of said heat exchange means.

9. A combination in accordance with claim 8, wherein said removing means comprises means for providing a flow of said liquid over said surfaces of said heat exchange means for flushing said substances therefrom.

10. A combination in accordance with claim 1, further comprising means for monitoring the acoustical intensity radiated by said ultrasonic cleaning means.

11. A combination in accordance with claim 1, further comprising means for monitoring the temperature of said ultrasonic cleaning means.

12. A combination in accordance with claim 1, wherein said array is substantially planar and is dimensioned so as to permit its passage between said spaced apart substantially parallel banks of pipe.

13. A combination in accordance with claim 12, wherein said transducers are disposed substantially in line and are disposed to produce bi-directional acoustic radiation from said portable substantially planar array to accomplish simultaneous cleaning of adjacent pipe banks when said cleaning means is disposed therebetween.

14. A combination in accordance with claim 12, wherein said liquid is seawater and said substance is biofouling.

15. An ultrasonic cleaning apparatus for immersion in a liquid environment in which an object to be cleaned resides comprising:

a housing forming a chamber therein;

a plate fixedly secured within said housing, said plate having a plurality of apertures disposed therethrough;

a plurality of ultrasonic transducers disposed within said apertures;

means for mounting said transducers within said apertures;

means for covering selected ends of said apertures, said covering means for reflecting acoustic radiation from said tranducers; and fluid means for filling said chamber of said housing, said fluid means for propagating acoustical waves from said transducers through said housing.

16. An apparatus in accordance with claim 15, wherein said apertures are arranged in said plate in a plurality of rows and columns.

17. An apparatus in accordance with claim 16, wherein alternate said apertures in said rows and columns are covered by said covering means on opposite sides of said plate so as to permit bi-directional radiation from said apparatus.

18. An apparatus in accordance with claim 15, wherein said covering means comprises a solid plate.

19. An apparatus in accordance with claim 15, wherein said mounting means comprises a plurality of support posts, one end of each post fixedly secured to an associated said transducer, said posts arranged radially about each of said transducers, the other ends of said posts fixedly secured to said plate adjacent to the perimeter of one of said apertures which is associated with one of said transducers.

20. An apparatus in accordance with claim 19, wherein said support posts are constructed of a vibration-dampening material.

21. An apparatus in accordance with claim 15, wherein said fluid means comprises a viscous liquid.

22. An apparatus in accordance with claim 15, further comprising means for positioning said plate proximate to said object to be cleaned.

23. An apparatus in accordance with claim 22, wherein said positioning means comprises means for moving and indexing said housing relative to said object.

24. An apparatus in accordance with claim 15, further comprising means for monitoring the acoustical intensity of said ultrasonic transducer as radiated from said housing.

25. An apparatus in accordance with claim 15, further comprising means for measuring the temperature within said housing.

26. An apparatus in accordance with claim 15, wherein said transducers are operable at sufficient power levels to cause cavitation in said liquid environment and therefore cavitation-type cleaning of said object to be cleaned.

27. An apparatus in accordance with claim 26, wherein said cavitation-type cleaning, at one atmosphere of pressure, is accomplished at power level between 0.5 to 2 watts/cm$^2$.

28. An apparatus in accordance with claim 15, wherein said transducers operate substantially within the frequency range of 18 Khz to 80 Khz.

29. An apparatus in accordance with claim 15, wherein said transducers are of the piezo-electric ceramic type.

30. An apparatus in accordance with claim 15, wherein said apertures and therefore said transducers are spaced apart a distance substantially equal to one half wavelength multiples of the operating frequency of said transducers.

31. An apparatus in accordance with claim 15, wherein said housing is constructed of a semi-resilient material.

32. A method for cleaning heat exchanger apparatuses functionally incorporating a plurality of spaced apart pipes having the external surfaces thereof in contact with a liquid which causes buildup of substances on said surfaces and reduces the heat transfer through said surfaces comprising the steps of:

positioning ultrasonic transducer means dimensioned for insertion between said spaced apart pipes within said liquid between said spaced apart pipes proximate to a surface of said pipes to be cleaned so that the energy radiated from said transducer is directed toward said surface;

applying power to said ultrasonic transducer means; and moving said ultrasonic transducer means relative to said surface of said heat exchanger at a rate permitting the cleaning thereof.

33. A method in accordance with claim 32, further comprising the steps of:

defining the surface to be cleaned in contact with said liquid prior to said positioning step;

monitoring the cleaning action of said at least one ultrasonic transducer subsequent to said applying of power step; and controlling said rate responsive to the information obtained by said monitoring step.

34. A method in accordance with claim 33, wherein said surface is defined and monitored by measuring the thermal transfer therethrough.

35. A method in accordance with claim 32, wherein said ultrasonic transducer is operated at power level sufficient to cause cavitation within said liquid and therefore cavitation-type cleaning of said surface.

36. A method in accordance with claim 32, further comprising the step of monitoring the power output of said at least one transducer.

37. A method in accordance with claim 32, wherein said plurality of spaced apart pipes are arranged in substantially parallel banks, said ultrasonic transducer means being dimensioned for insertion between said spaced apart banks.

38. A method in accordance with claim 37, wherein said ultrasonic transducer means comprises a substantially planar array of transducers arranged to radiate the bi-directionally from said array for simultaneous cleaning of said surfaces of adjacent banks of said spaced apart pipes.

* * * * *